US006877640B1

(12) United States Patent
Frushone

(10) Patent No.: US 6,877,640 B1
(45) Date of Patent: Apr. 12, 2005

(54) DEVICE FOR DISPENSING LIQUID OR POWDER TO WASHING MACHINE AND THE LIKE

(76) Inventor: Kevin Frushone, 2718 Ariane Dr., No. 29, San Diego, CA (US) 92117

( * ) Notice: Subject to any disclaimer, the term of this patent is extended or adjusted under 35 U.S.C. 154(b) by 4 days.

(21) Appl. No.: 10/397,675

(22) Filed: Mar. 26, 2003

(51) Int. Cl.[7] ..... B67D 5/38

(52) U.S. Cl. ..... 222/158; 222/444; 222/450; 222/561

(58) Field of Search ..... 222/157, 158, 222/425, 444, 450, 561

(56) References Cited

U.S. PATENT DOCUMENTS

| | | | | | |
|---|---|---|---|---|---|
| 813,977 | A | * | 2/1906 | Konig | 222/158 |
| 825,345 | A | * | 7/1906 | Perrotti | 141/372 |
| 1,286,646 | A | * | 12/1918 | Jenkins | 222/157 |
| 1,520,637 | A | * | 12/1924 | Peter | 222/158 |
| 2,626,089 | A | * | 1/1953 | Osfar | 222/511 |
| 2,873,050 | A | * | 2/1959 | Halverson | 222/158 |
| 3,212,671 | A | * | 10/1965 | Rock | 222/1 |
| 3,607,100 | A | * | 9/1971 | Croom | 422/100 |
| 3,774,603 | A | * | 11/1973 | McPhee | 604/246 |
| 3,814,294 | A | * | 6/1974 | Stevenson | 222/181.2 |
| 4,105,142 | A | * | 8/1978 | Morris, Jr. | 222/158 |
| 4,380,309 | A | * | 4/1983 | Takahashi | 222/450 |
| 5,513,777 | A | * | 5/1996 | Yoda et al. | 222/325 |
| 5,529,219 | A | * | 6/1996 | Ward | 222/156 |

* cited by examiner

*Primary Examiner*—Joseph A. Kaufman
(74) *Attorney, Agent, or Firm*—Howard C. Miskin, Esq.; Gloria Tsui-Yip, Esq.

(57) ABSTRACT

A device for dispensing a predetermined measured volume of a fluent material, such as liquid and/or powder, to a washing machine. The device includes a container for storing the fluent material, a flexible tube for delivering the fluent material from the container to the washing machine and at least two control valves along the flexible tube for interrupting the flow of the fluent material. The two control valves define an intermediate portion of the flexible tube having a predetermined measured volume. The first valve is opened to allow the fluent material to flow into and fill the intermediate portion. The second valve is opened after closing the first valve to allow the predetermined volume of fluent material to flow into the washing machine.

11 Claims, 6 Drawing Sheets

DEVICE FOR DISPENSING LIQUID OR POWDER TO WASHING MACHINE AND THE LIKE

FIELD OF THE INVENTION

The invention relates to a device for dispensing a fluent material, such as liquid and/or powder, to the next step of a process, such as a washing machine and the like. In particular, a device that dispenses a predetermined measured volume of detergent and/or softener into a washing machine by actuating two "one-touch" control valves.

BACKGROUND OF THE INVENTION

Washing detergent and fabric softener, in liquid or powder form, must be measured before being poured into a washing machine to avoid overflow of suds or not obtaining a clean wash. Typically, manufacturers conveniently provide the detergent and/or softener containers with a cap having pre-marked measurements for measuring different volumes of detergent and/or softener. The trend to reduce costs is to make the container larger and heavier. This prior art method of dispensing and measuring detergent and/or softener disadvantageously requires physical strain in lifting the containers, pouring the detergent and/or softener into a separate measuring device with an increased risk of overflowing the cap, which is wasteful. Further, too much detergent and/or softener is not good for the clothing.

Some detergent manufacturers attempt to overcome the need to lift the containers by providing a push valve on the side of the container and with the placement of the container directly above the washing machine, allows detergent to flow from the push valve directly into a washing machine. However, this method disadvantageously precludes measurements of the amount of detergent used.

Therefore, there is a need for a device that conveniently and cleanly dispenses predetermined volume of detergent and/or softener into a washing machine without the need to pour the detergent and/or softener into a separate measuring device.

SUMMARY OF THE INVENTION

The present invention provides a dispenser having a wall mounted storage container, a flexible tube and at least two control valves located along the flexible tube.

The dispenser of the present invention comprises a storage container for detergent and/or softener preferably mounted on a wall in some manner, adjacent the washing machine, a flexible tube connecting the storage container to the washing machine. Intermediate of the flexible tube are at least two "one-touch" control valves, defining between the two valves is the intermediation portion of the tube.

To operate the dispenser of the present invention, the first valve closer to the storage container is opened, allowing gravity to draw the liquid or powder from the storage container through the flexible tube to the intermediate section. When the section is filled to a predetermined amount, the first valve is closed and the measured volume of liquid or powder is then dispensed into the washing machine by opening the second valve closer to the washing machine.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
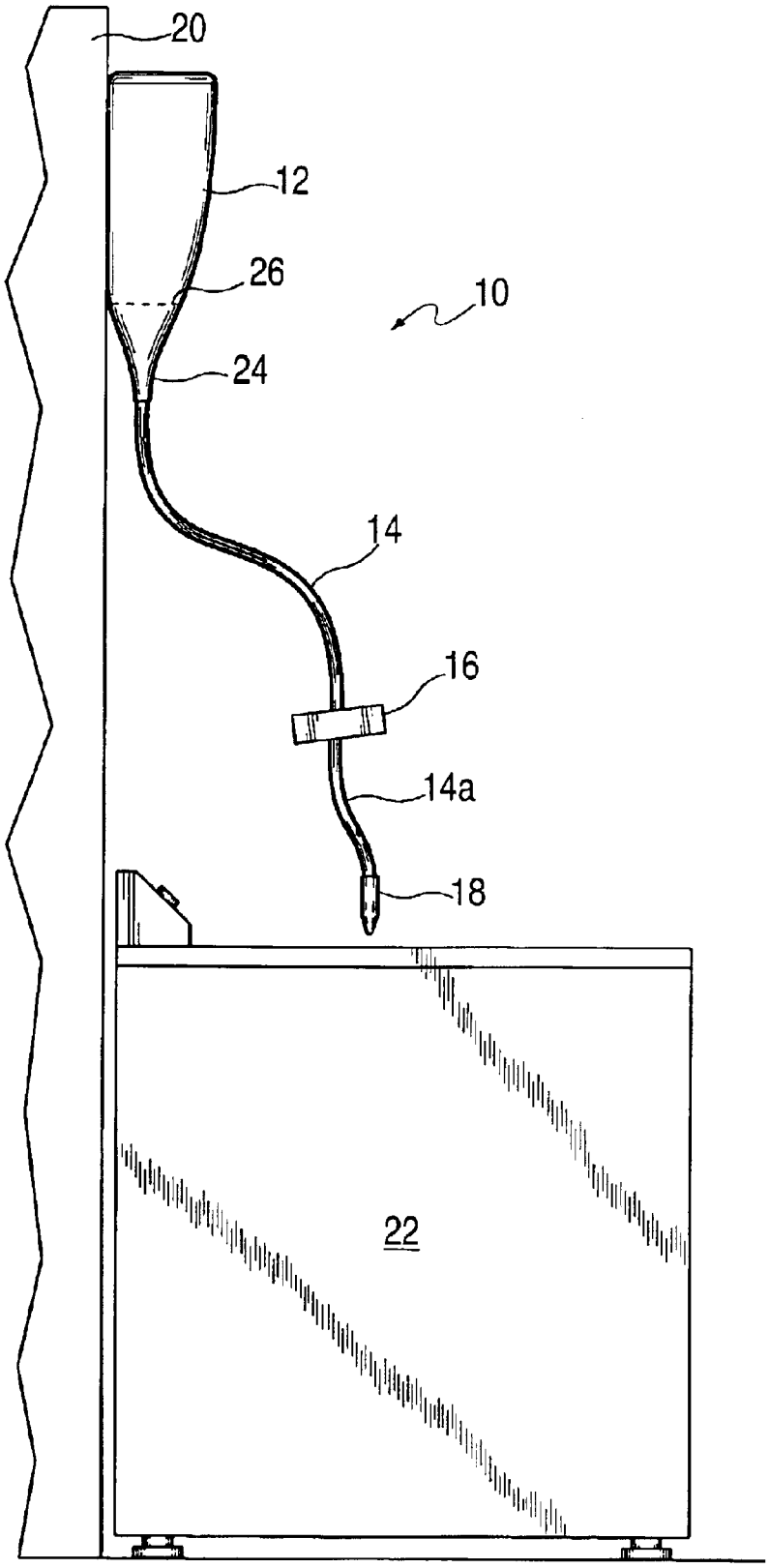
FIG. 1 is a schematic of the device of the present invention, illustrating the wall mounted storage container, flexible tube and two control valves.

With reference to the drawings, wherein the same reference number indicates the same element throughout, there is shown in FIG. 1 a dispenser 10 of the present invention. The dispenser 10 comprises a storage container 12, a flexible tube 14 and two control valves 16 and 18.

As shown in FIG. 1, the container 12 is for storing a fluent material such as detergent and/or softener, either is liquid or powder form (not shown). Container 12 is mountable on a wall 20 above the washing machine 22 to promote flow of the fluent material in the container 12 by gravitational force. Preferably the container 12 has a circular or square funnel shape with a smaller bottom end 24 to further promote flow of the fluent material. An indicia such as "Refill Line" 26 may be provided on the container 12 as a reminder to the user to refill the container with additional fluent material when the fluent material dropped below the "Refill Line" 26.

The bottom end 24 of the container 12 is connected to one end of a flexible tube 14, with the opposite end of the flexible tube 14 located above the washing machine 22, which may be removably positioned into the washing machine 22 when dispensing the fluent material.

Intermediate of the flexible tube 14 are two "one-touch" control valves 16 and 18 (to be discussed in detail with FIGS. 4–8), defining an intermediate portion 14*a* of the tube 14 therebetween. The intermediate portion 14*a* of tube 14 defines a predetermined measured volume when filled with the fluent material.

To utilize the dispenser 10 of the present invention, the first valve 16 is opened, allowing gravity to draw the fluent material from the storage container 12 through the flexible tube 14 to the intermediate portion 14*a* of the tube 14. When the intermediate portion 14*a* is filled to the predetermined volume, the first valve 16 is closed and the measured volume of fluent material in the intermediate portion 14*a* is then dispensed into the washing machine 22 by opening the second valve 18.

Figure 2:
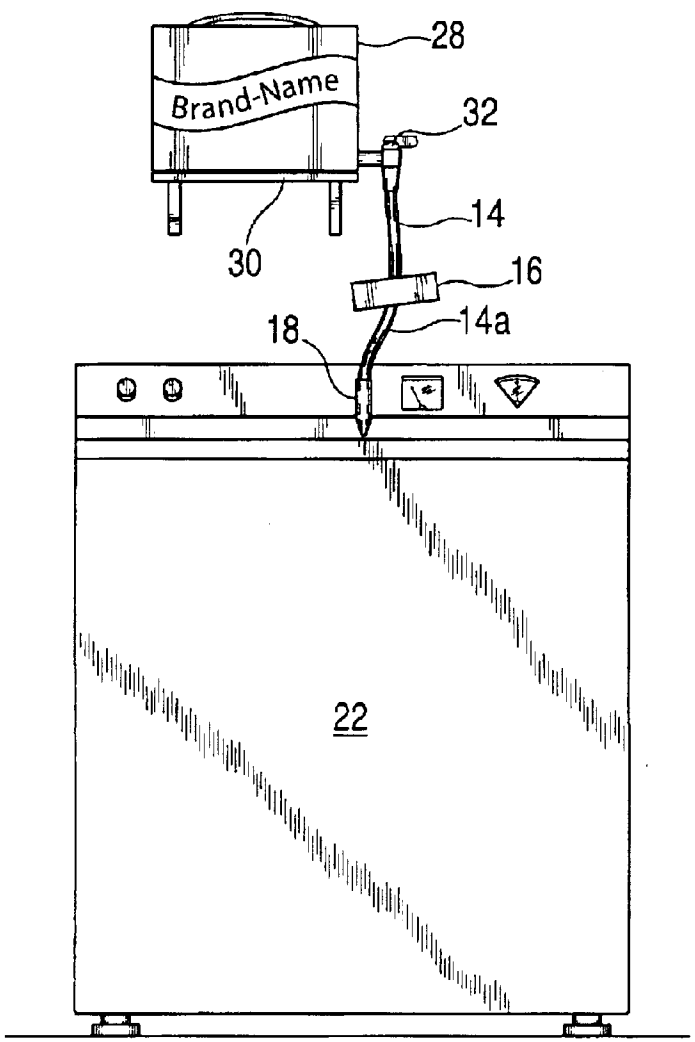
FIG. 2 is a schematic of a second embodiment of the device of the present invention, illustrating a standard container placed on a wall mounted shelf, with the flexible tube and two control valves attached to the container.

FIG. 2 shows a second embodiment of the present invention, with the wall mounted container 12 of FIG. 1 replaces by a standard manufacturer's container 28 placed on top of a wall mounted shelf 30. A standard manufacturer's container 28 has a spout 32 for dispensing the detergent or softener in the container 28. Tube 14 is removably attached to the spout 32. The remaining components, valves 16 and 18, are the same as shown in FIG. 1.

Figure 3:
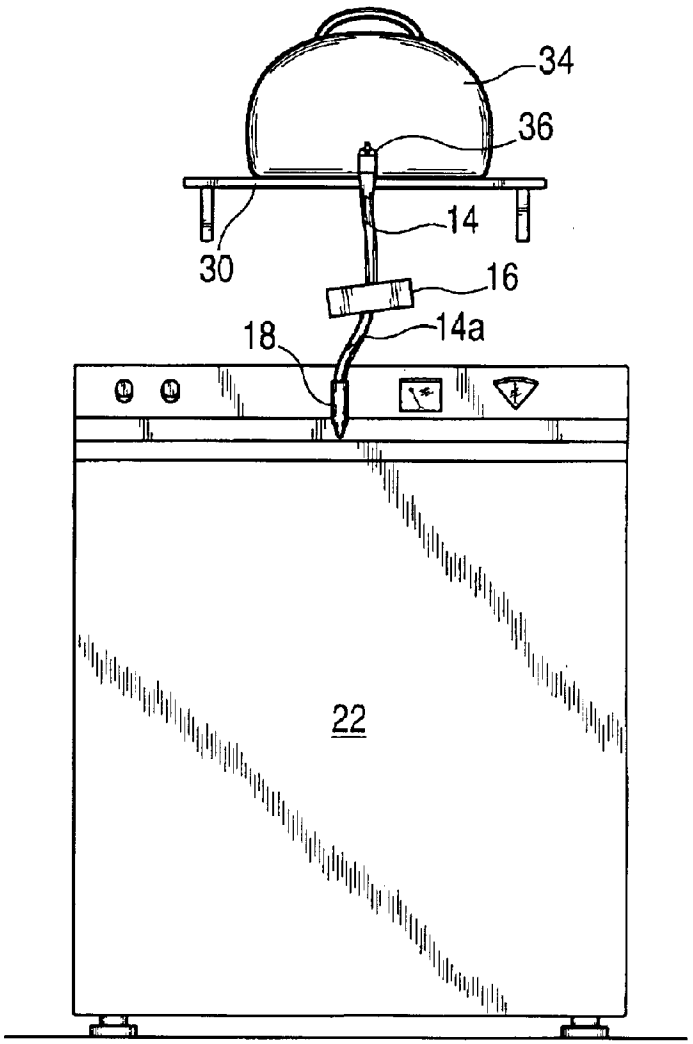
FIG. 3 is a schematic of a third embodiment of the device of the present invention, illustrating a storage container placed on a wall mounted shelf, with the flexible tube and two control valves attached to the container.

FIG. 3 shows a third embodiment of the present invention, with the wall mounted container 12 of FIG. 1 replaces by a storage container 34 placed on top of a wall mounted shelf 30. Storage container 34 is manufactured to enhance gravity, as known to one skilled in the art, to allow more fluent flow. Storage container 34 has a spout 36 for dispensing the detergent or softener in the container 34. Tube 14 is removably attached to the spout 34. The remaining components, valves 16 and 18, are the same as shown in FIG. 1.

Figure 4:
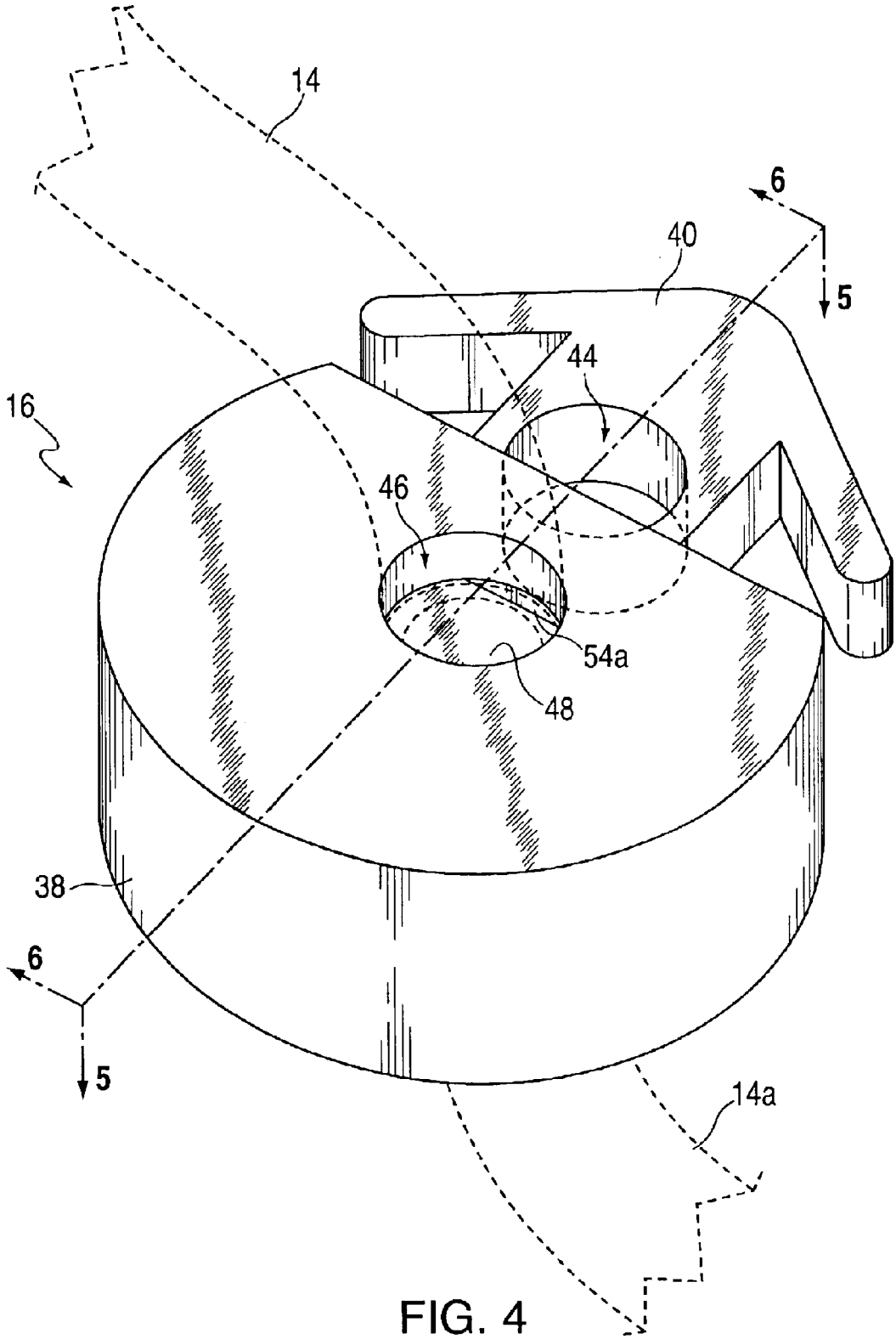
FIG. 4 is a perspective view of the control valve in the closed position.
Figure 5:
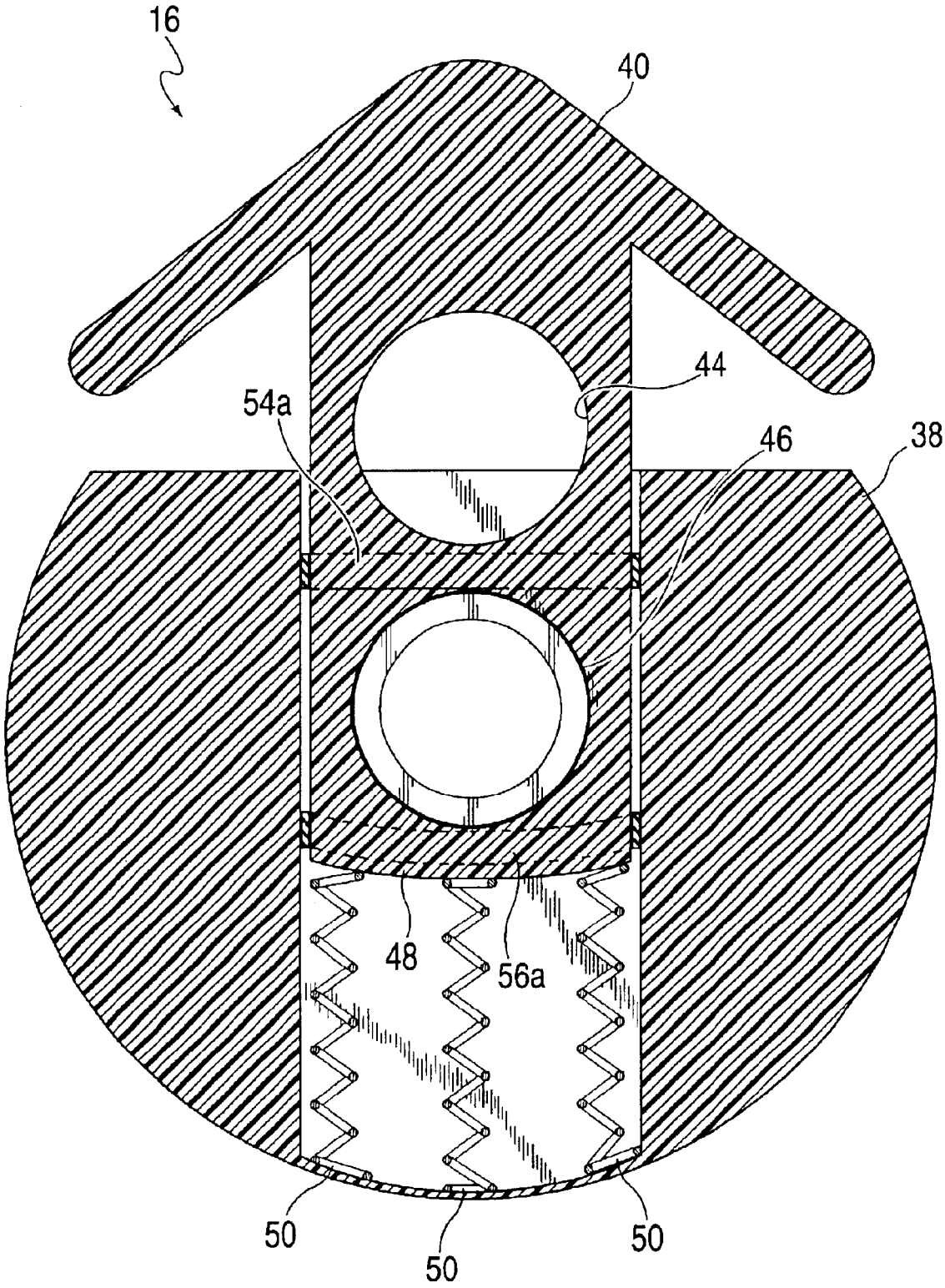
FIG. 5 is a top plan view of the control valve taken at line 5—5 in FIG. 4.
Figure 6:
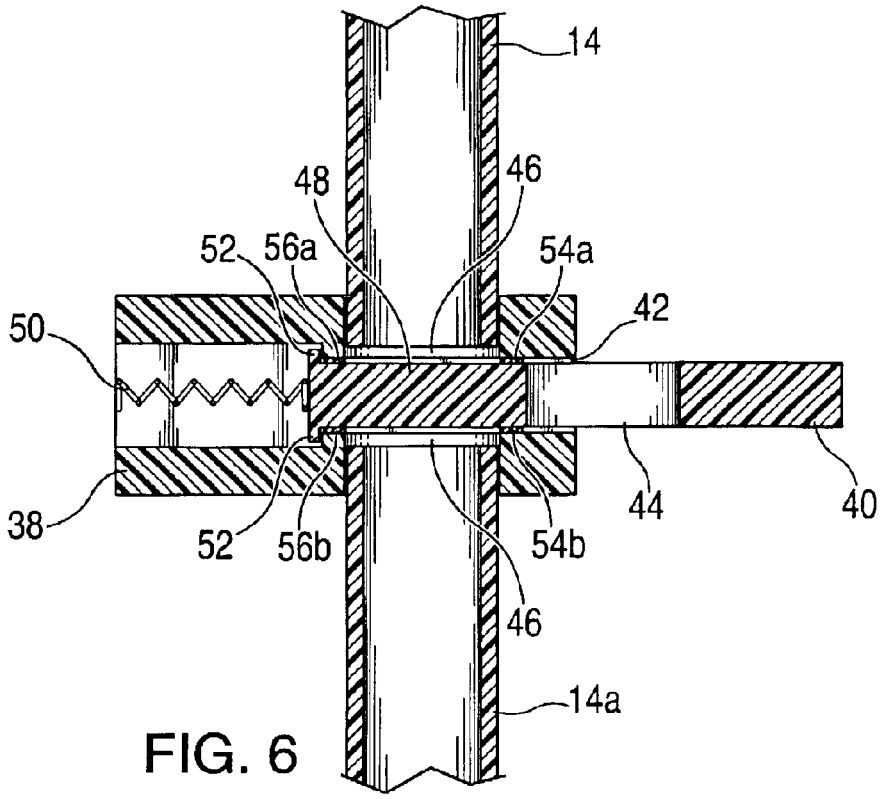
FIG. 6 is a cross sectional view of the control valve taken at line 6—6 in FIG. 4.

FIGS. 4, 5 and 6 show the control valves 16 or 18 in the closed position. Control valve 16 comprises a body 38 and an actuating button or handle 40, which is slidably engaged in a slot 42 (shown in FIG. 6) sandwiched between the body 38. Actuating handle 40 is biased by a plurality of stainless steel springs 50 to a closed position. Stop 52 at the elongated end 48 of the actuating handle 40 prevents the handle 40 from dislodging from slot 42. In the closed position, the elongated end 48 of the actuating handle 40 along with the straight edge rubber strip 54*a* and the curved rubber strip 56*a*, both strips extending from slot 42 of the body 38, prevent the flow of the fluent material from tube 14 to the intermediate portion 14*a*. Actuating handle 40 has an opening 44 and body 38 has an opening 46 substantially similar in size as opening 44.

Figure 8:
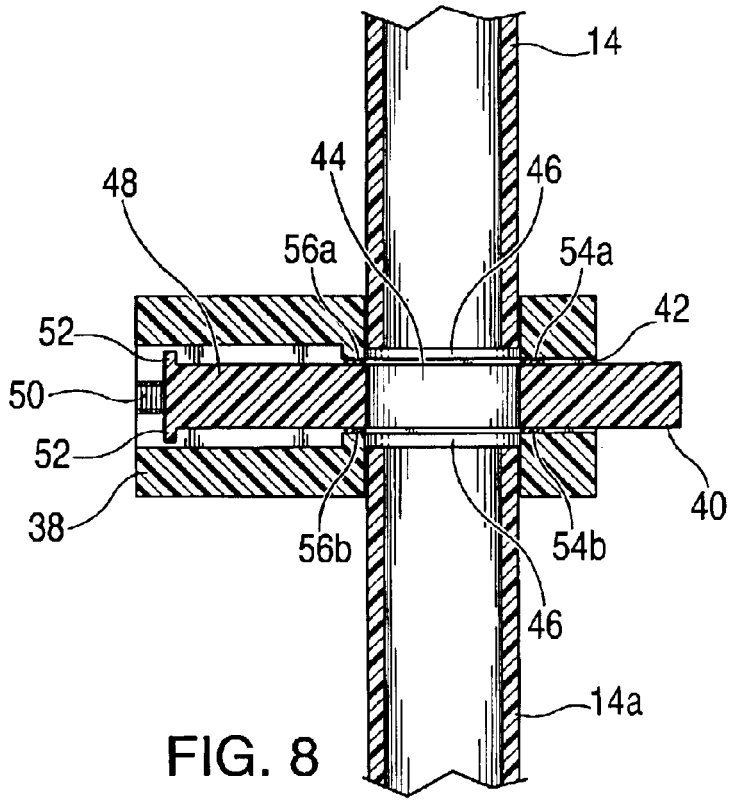
FIG. 8 is a cross sectional view of the control valve taken at line 8—8 in FIG. 7.
Figure 7:
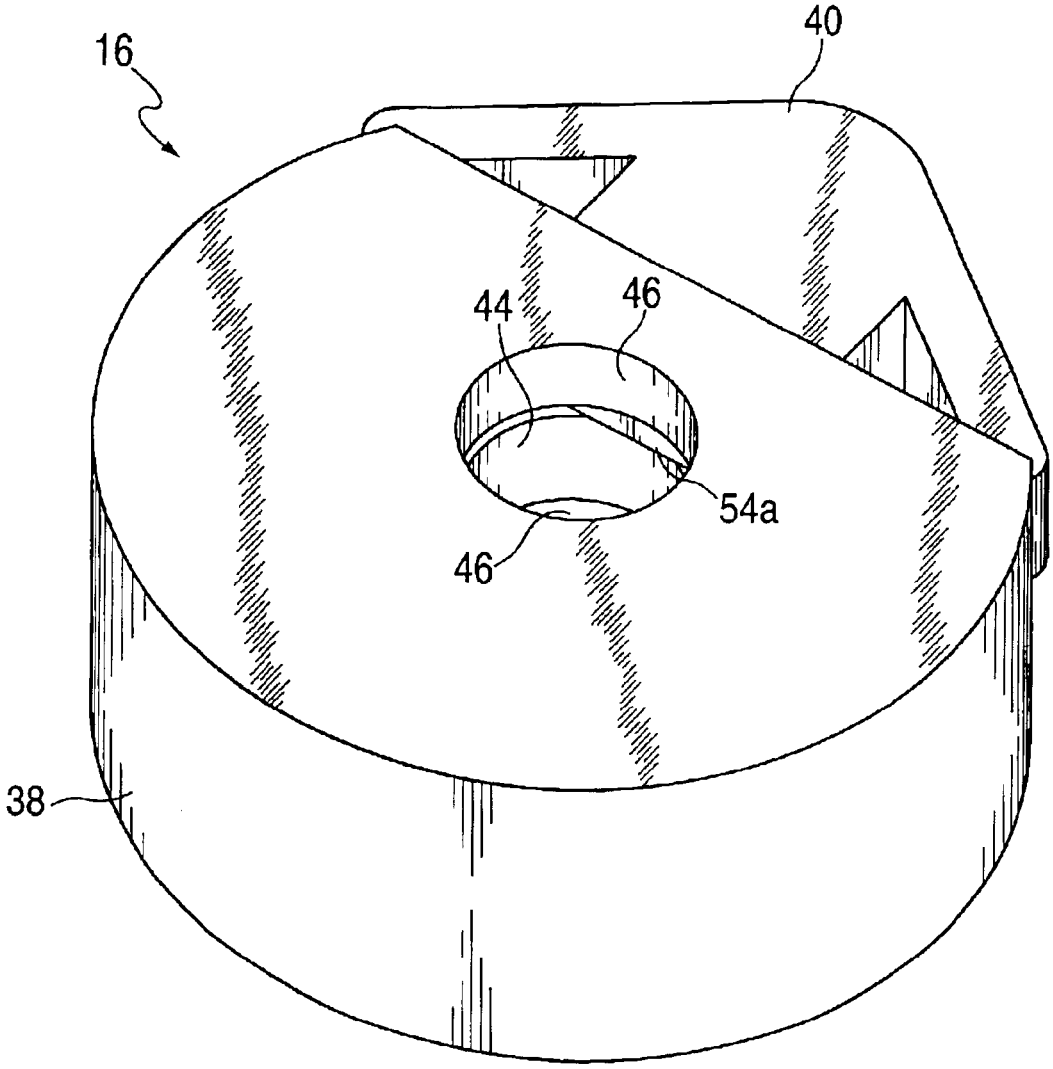
FIG. 7 is a perspective view of the control valve in the open position.

FIGS. 7 and 8 show the control valve 16 or 18 in the open position. When actuating handle 40 is pushed against the body 38, compressing springs 50, opening 44 of the handle 40 and opening 46 of the body 38 are aligned to allow flow of the fluent material from tube 14 to the intermediate portion 14*a*. Upon releasing the pressure on handle 40, the springs 50 return the handle 40 to the closed position as shown in FIGS. 4, 5, and 6. Rubber strips 54*a*, 54*b*, 56*a* and 56*b* cleanse the fluent material from the handle 40 to prevent build up when the valve 16 goes from an open position to a closed position.

The features of the invention illustrated and described herein is the preferred embodiment. Therefore, it is understood that the appended claims are intended to cover unforeseeable embodiments with insubstantial differences that are within the spirit of the claims.

What I claim is:

1. The device for dispensing a predetermined volume of fluent material to a washing machine comprising:

a container for storing the fluent material, said container adapted to be removably mounted above and adjacent the washing machine;

a flexible tube having a proximal end, a distal end and a central portion between said proximal and distal ends, said proximal end is removably connected to said container for conveying the fluent material from said container to the washing machine; and at least two control valves along said flexible tube for selectively interrupting the conveyance of the fluent material, at least one of said control valves is located at said central portion of said flexible tube and at least another one of said control valves is located at said distal end of said flexible tube, with the length of tubing between said two control valves defining an intermediate portion of said flexible tube having the predetermined volume;

wherein each of said control valves comprising:

a body having a slot and an opening;

an actuating handle slidably engaged in said slot and sandwiched between said body for opening and closing said valve, said handle having an enlarged end and an opening adjacent said enlarged end;

means for biasing said handle with said valve in a closed position to prevent flow of said fluent material such that said opening of said handle is at least partially outside said slot of said body, wherein said valve is opened when said opening of said body and said opening of said handle are in alignment.

2. The device of claim 1 having first and second control valves, wherein the first valve is opened to allow the fluent material to flow from said container through said flexible tube to said intermediate portion of said flexible tube, and when said second valve is opened after said first valve is closed, the predetermined volume of fluent material in said intermediate portion of said flexible tube is dispensed into the washing machine.

3. The device of claim 1 wherein said container having a circular funnel shape.

4. The device of claim 1 wherein said container having a square funnel shape.

5. The device of claim 1 wherein said container having an indicia indicating when additional fluent material needs to be added to said container.

6. The device of claim 1 wherein said container having a bottom end, said flexible tube having first and second ends, said first end of said tube being connected to said bottom end of said container and said second end of said tube being removably positioned into the washing machine.

7. The device of claim 1 wherein said container is a standard manufacturer's container.

8. The device of claim 1 wherein said container having a spout for dispensing the fluent material, wherein said flexible tube is removably connected to said spout.

9. The device of claim 1 wherein said handle further having an elongated end opposite said enlarged end, said biasing means comprising at least one spring engaging said elongated end of said handle.

10. The device of claim 9 wherein said elongated end having a stop to prevent the dislodgement of said handle from said slot of said body.

11. The device of claim 1 wherein at least one rubber strip extending from and into said slot of said body adjacent said opening of said body, said at least one rubber strip engages said elongated end of said handle.

* * * * *